US005088666A

United States Patent [19]

Lang

[11] Patent Number: 5,088,666

[45] Date of Patent: Feb. 18, 1992

[54] HOSE ANCHORS

[76] Inventor: Paul A. Lang, 7960 Grafton Ave. S., Cottage Grove, Minn. 55016

[21] Appl. No.: 577,036

[22] Filed: Sep. 4, 1990

[51] Int. Cl.[5] ..... A47G 29/00

[52] U.S. Cl. ..... 248/87; 248/175; 239/276

[58] Field of Search ..... 248/87, 88, 75, 76, 248/80, 85, 175, 82, 84, 92, 302; 239/276, 280

[56] References Cited

U.S. PATENT DOCUMENTS

| | | | |
|---|---|---|---|
| 1,129,197 | 2/1915 | Howes | 248/88 |
| 2,536,341 | 1/1951 | Asher | 248/87 |
| 2,574,441 | 11/1951 | Stewart | 248/87 |
| 3,227,408 | 1/1966 | Reed | 248/87 |
| 3,239,174 | 3/1966 | Churchman | 248/87 |
| 4,440,370 | 4/1984 | Rood | 248/87 |

FOREIGN PATENT DOCUMENTS

| | | | |
|---|---|---|---|
| 0112346 | 1/1941 | Australia | 248/87 |
| 0938581 | 10/1963 | United Kingdom | 248/87 |

*Primary Examiner*—Ramon O. Ramirez
*Attorney, Agent, or Firm*—Burd, Bartz & Gutenkauf

[57] ABSTRACT

A lawn and garden hose anchor is disclosed which comprises a first elongated soil-engaging straight spindle member adapted to be inserted vertically into the ground, and a second hose-engaging member integral therewith and offset laterally with a hose-engaging loop. Two forms of hose-engaging loop are disclosed for anchoring either flat cross section soaker-type hose or conventional circular cross section hose. The first of these is a relatively flat clip or clamp. The other is a single loop helix having a straight end segment extending tangentially upward spaced from and generally parallel to the spindle.

13 Claims, 2 Drawing Sheets

HOSE ANCHORS

FIELD OF THE INVENTION

This invention relates to anchors for holding lawn and garden watering hose, including porous membrane hose, in place while laying stretched out on the ground. The anchors permit the hose to be arrayed in orderly fashion.

SUMMARY OF THE INVENTION

Broadly stated, the lawn and garden hose anchors according to the present invention comprise a first elongated soil-engaging straight spindle-like member adapted to be inserted vertically into the ground, and a second hose-engaging member which is integral with the first member and is offset laterally from the first member and having a hose-engaging loop. The axis of the hose-engaging loop extends generally horizontally when the anchor is in place in the ground to hold the hose parallel to the ground surface. Separate forms of hose anchor are disclosed for typical flat and round hoses as are in common use.

BRIEF DESCRIPTION OF THE DRAWINGS

The invention is illustrated by the accompanying drawings in which, corresponding parts are identified by the same numerals and in which.

DETAILED DESCRIPTION OF THE PREFERRED EMBODIMENTS

Figure 1:
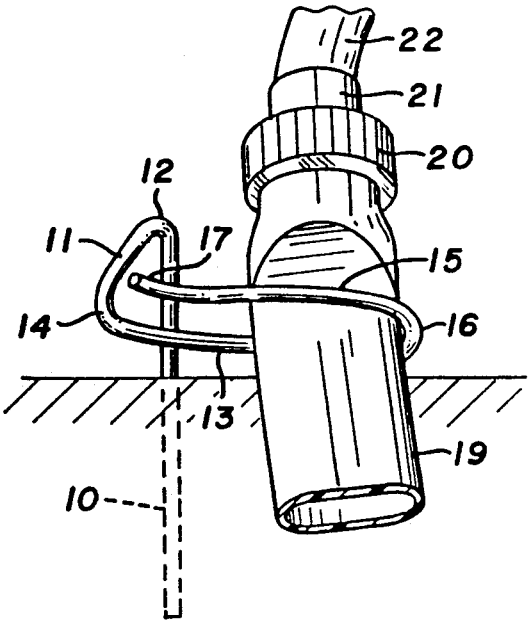
FIG. 1 is a fragmentary perspective view showing one form of hose anchor according to the present invention holding a flat soaker-type hose in place.

Referring now to the drawings, and particularly to FIGS. 1 through 4, there is shown a first form of hose anchor according to the present invention specifically adapted for holding generally flat soaker-type hose. The hose anchor is formed, for example, from steel rod, or steel, aluminum or copper wire, or from synthetic resinous plastics of suitable strength and durability, or the like. It is preferably circular in cross section and has a diameter from about ⅛ to $\theta$ inch, preferably about 3/16 inch.

The anchor includes a first elongated soil-engaging straight stiff spindle-like member 10 adapted to be inserted vertically into the ground. First member 10 preferably has a length of at least about 3 to 6 inches sufficient to securely engage enough soil to hold the hose against dislodgement when pushed into the ground.

The hose-engaging second member includes a first straight segment 11 bent at elbow 12 at approximately a right angle to the top end of the member 10. Segment 11 thus lies horizontally, generally parallel to the ground surface when the anchor is in place. A second straight segment 13 is bent at elbow 14 at an angle between about 60° and 90° to segment 11. Segments 11 and 13 of the hose-engaging member lie in a common plane which is generally horizontal and parallel to the ground surface.

Straight segment 13 forms the bottom portion of a hose engaging clip or clamp. The top portion of that clip or clamp is formed by a third generally straight segment 15 overlying the second segment 13 and connected thereto by a fourth semi-circular arcuate segment 16 at the end opposite from the elbow connection 14 between the first and second segments.

The third segment 15 of the hose-engaging member is spaced from the second segment 13 by about the thickness of a flat soaker-type lawn and garden hose, typically about ⅜ to ½ inch. A fifth relatively shorter straight terminal segment 17 is integral with the end of the third segment 15 and in general longitudinal alignment therewith. The third segment 15 preferably inclines inwardly toward the second segment 13 at an angle between about 5° and 10° and the fifth segment 17 is then optionally but preferably inclined outwardly at an angle of at least about 5° so as to form a slightly flaring opening to a slightly constricted throat entering into the open side of loop portion 18 into which the flat hose is received.

Figure 2:
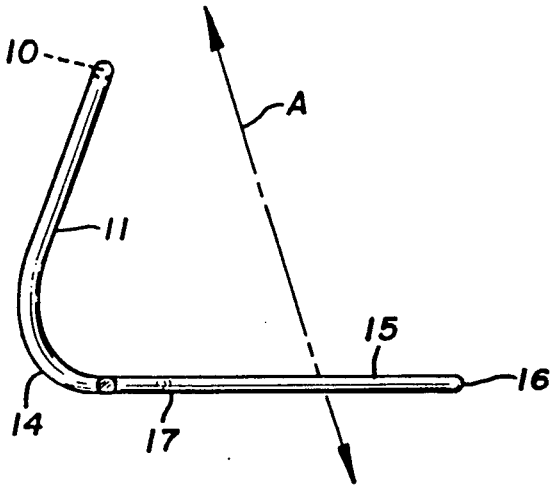
FIG. 2 is a top plan view of the hose anchor on a somewhat enlarged scale.
Figure 3:
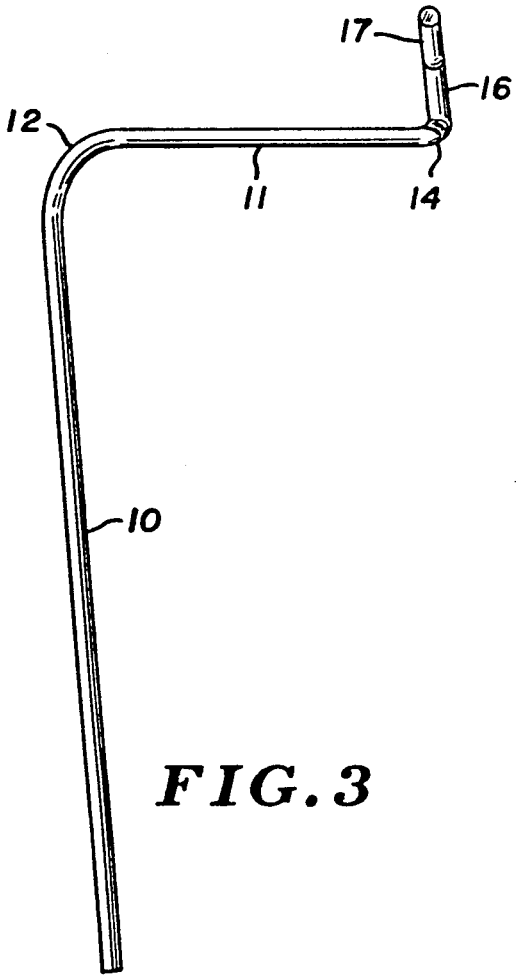
FIG. 3 is a side elevation thereof.
Figure 4:
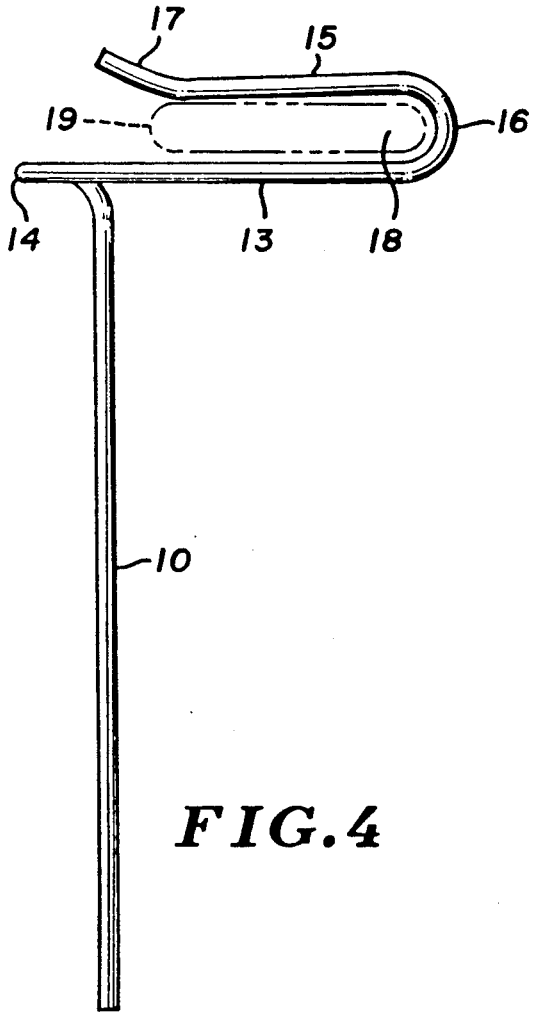
FIG. 4 is a front elevation thereof.

One or more hose anchors may be utilized to hold a hose in place. As best seen in FIG. 1, one hose anchor preferably engages the hose 19 closely adjacent to the end having a connector 20 for attachment to the connector 21 of a supply hose 22. The hose lies generally along the axis A (FIG. 2). Additional anchors as needed may be used, for example, to conform the hose to the shape of the plot of ground to be watered for maximum utilization of the water without waste. A straight hose may be readily made to conform to a plot bounded by an arcuate sidewalk, a hedge row or driveway or the like.

Referring now to FIGS. 5 through 8, there is shown an alternative form of hose anchor adapted for use with a lawn or garden hose of circular cross section. This hose anchor includes a first elongated soil-engaging straight spindle-like member 10A adapted to be inserted vertically into the ground, as already described.

The second hose-engaging member is in the form of a single loop helix 25 integral with the first member 10. The inside diameter of the helix 25 is of a size to receive an ordinary round cross section lawn and garden hose, typically about ½ to 1 inch. The helix 25 is offset laterally from the end of the first spindle-like member 10A and may terminate in a straight end segment 26 which extends tangentially upward generally parallel to the first member. The segment 26 is spaced from member 10A by a distance no greater than the diameter of the helix, and preferably about ½ to 1 inch diameter. In order to effectively retain the hose within the helix, the end segment 26 need extend no higher than the longitudinal axis A′ of the helix, and, as shown, should extend no higher than the periphery of the helix.

Figure 5:
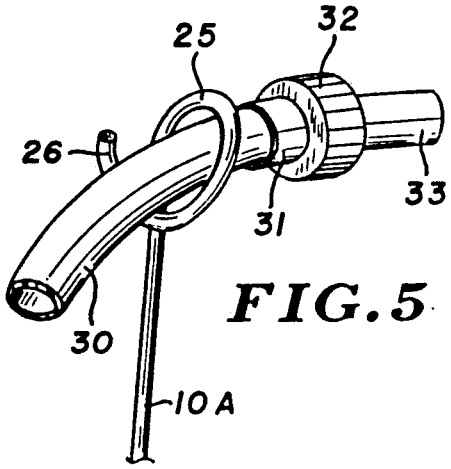
FIG. 5 is a fragmentary perspective view showing another form of hose anchor holding a round lawn and garden hose.
Figure 6:
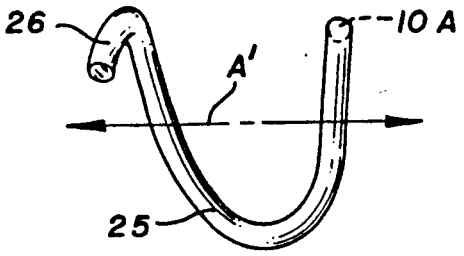
FIG. 6 is a top view of the alternative form of hose anchor on a somewhat enlarged scale.
Figure 7:
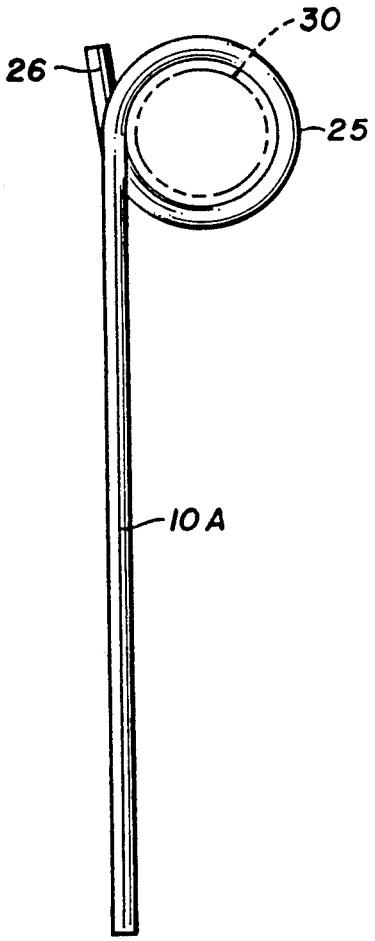
FIG. 7 is a front elevation thereof.
Figure 8:
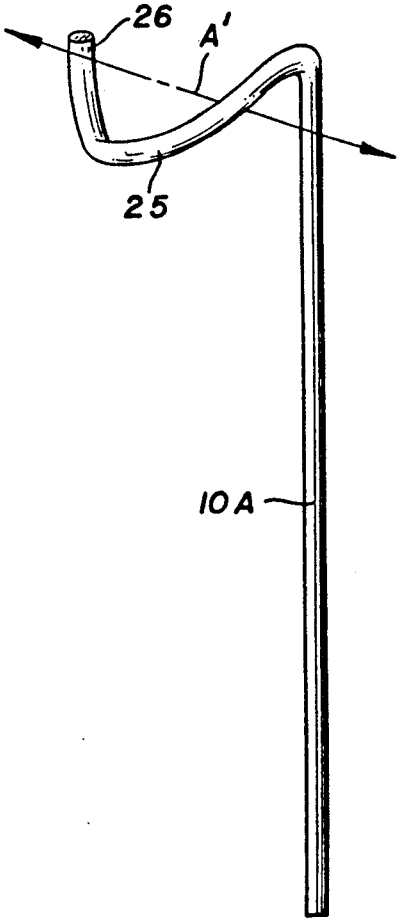
FIG. 8 is a side elevation thereof.

To engage the anchor, the hose is inserted from the bottom side of the helix into the upper arcuate segment thereof and flipped over the top end of the end piece 26 so that the connector end of the hose rests in the bottom arcuate segment of the helix, as seen in FIG. 5.

One or more hose anchors are used, depending upon individual circumstances dictating the desirability of securing the hose in place. Preferably the anchor engages the hose at one end adjacent the coupling as shown, where connector 31 engages connector 32 of another hose segment 33. A nozzle may be attached to the male coupling 31 of hose 30 and held in place by the hose anchor at an appropriate angle to sprinkle a predetermined ground area.

It is apparent that many modifications and variations of this invention as hereinbefore set forth may be made without departing from the spirit and scope thereof. The specific embodiments described are given by way of example only and the invention is limited only by the terms of the appended claims.

I claim:

1. A lawn and garden hose anchor comprising:

A) a first elongated soil-engaging straight stiff spindle member adapted to be inserted vertically into the ground, and B) a hose-engaging second member integral with aid first member, aid second member:

1) being offset laterally from the longitudinal axis of said first member, and 2) having a hose-engaging loop lying in a plane spaced from and generally parallel to the longitudinal axis of said first member, the axis of said loop lying in a plane generally perpendicular to the longitudinal axis of said first member.

2. A hose anchor according to claim 1 wherein said first and second members are formed from a single length of steel rod or metal wire.

3. A hose anchor according to claim 1 wherein said first member has a length of at least about 3 to 6 inches.

4. A hose anchor according to claim 2 wherein said steel rod or wire has a diameter of about ⅛ to ¼ inch.

5. A hose anchor according to claim 1 wherein said second member comprises:

A) a first straight segment bent at approximately a right angle to the top end of said first member, B) a second straight segment bent at an angle between about 60° and 90° to said first segment and in the same plane as the first straight segment, and C) a third generally straight segment overlying said second segment spaced apart therefrom and connected thereto by a fourth arcuate segment at the end opposite from the connection between the first and second segments.

6. A hose anchor according to claim 5 wherein:

A) the free end of said third segment inclines inwardly toward said second segment at an angle between about 5° and 10°, and B) a fifth straight segment is connected to the free end of said third segment and inclines outwardly at an angle of at least about 5°.

7. A hose anchor according to claim 5 wherein said second and third segments of said hose-engaging member are spaced apart by about the thickness of a flat soaker-type lawn and garden hose adapted to be received therein.

8. A lawn and garden hose anchor comprising:

A) a first elongated soil-engaging straight spindle member of length at least about 3 to 6 inches adapted to be inserted vertically into the ground, and B) a hose-engaging second member integral with said first member and comprising:

1) a first straight segment bent at approximately a right angle to the top end of said first member, 2) a second straight segment bent at an angle between about 60° and 90° to said first segment and in a plane generally perpendicular to the longitudinal axis of the first member, a third generally straight segment overlying said second segment and spaced apart therefrom by about the thickness of a flat soaker-type lawn and garden hose adapted to be received between said second and third segments, said third segment being connected to said second segment by a fourth semicircular arcuate segment at the end opposite from the connection between the first and second segments.

9. A lawn and garden hose anchor according to claim 9 wherein:

A) the free end of said third segment inclines inwardly toward said second segment at an angle between about 5° and 10°, and B) a fifth straight segment is connected to the free end of said third segment and inclines outwardly at an angle of at least about 5°.

10. A hose anchor according to claim 8 wherein said first and second members are formed from a single length of steel rod or metal wire having a diameter of about ⅛ to ¼ inch.

11. A lawn and garden hose anchor comprising:

A) a first elongated soil-engaging straight stiff spindle member having a length at least about 3 to 6 inches, and B) a hose-engaging second member integral with said first member and comprising a single loop open helix offset laterally from the longitudinal axis of said first member, one end of said helix being an extension of said first member and the opposite free end being spaced laterally therefrom, the inside diameter of said helix loop being about ½ to 1 inch, the longitudinal axis of said helix loop lying in a plane generally perpendicular to the longitudinal axis of said first member, and the free end of said helix loop being spaced from said first member by a distance no greater than the diameter of the loop.

12. A hose segment according to claim 11 wherein the free end of said helix loop includes a straight end segment extending tangentially upward generally parallel to said first member and no higher than the periphery of the helix loop.

13. A hose anchor according to claim 11 wherein said first and second members are formed from a single length of steel rod or metal wire of diameter about ⅛ to ¼ inch.

* * * * *

UNITED STATES PATENT AND TRADEMARK OFFICE

CERTIFICATE OF CORRECTION

PATENT NO. : 5,088,666

DATED : February 18, 1992

INVENTOR(S) : Paul A. Lang

It is certified that error appears in the above-identified patent and that said Letters Patent is hereby corrected as shown below:

Col. 1, line 54, delete "$\Theta$" and insert --- ¼ ---.

Col. 3, line 15, delete "aid" and insert --- said ---.

Col. 3, line 16, delete "aid" and insert --- said ---.

Col. 4, line 21, delete "9" and insert --- 8 ---.

Signed and Sealed this

Sixth Day of July, 1993

*Attest:*

Michael K. Kirk

MICHAEL K. KIRK

*Attesting Officer*

*Acting Commissioner of Patents and Trademarks*